US005222453A

United States Patent [19]

Chabot

[11] Patent Number: 5,222,453

[45] Date of Patent: Jun. 29, 1993

[54] APPARATUS AND METHOD FOR REDUCING MOTION RESPONSE OF MARINE STRUCTURES

[75] Inventor: Luc G. Chabot, LaPlace, La.

[73] Assignee: Odeco, Inc., New Orleans, La.

[21] Appl. No.: 488,668

[22] Filed: Mar. 5, 1990

[51] Int. Cl.[5] ..... B63B 21/50

[52] U.S. Cl. ..... 114/230; 114/293

[58] Field of Search ..... 114/230, 293, 294, 265, 114/243, 144 B; 441/3, 4, 5

[56] References Cited

U.S. PATENT DOCUMENTS

| | | | |
|---|---|---|---|
| 2,397,957 | 4/1946 | Freeman | 114/243 |
| 3,111,926 | 11/1963 | Shatto | 114/293 |
| 3,903,705 | 9/1975 | Beck et al. | 114/293 |
| 4,090,463 | 5/1978 | Soderberg | 114/293 |
| 4,167,147 | 9/1979 | Bergman | 114/265 |

FOREIGN PATENT DOCUMENTS

| | | | |
|---|---|---|---|
| 3144228 | 5/1983 | Fed. Rep. of Germany | 114/293 |
| 17782 | 2/1981 | Japan | 114/293 |
| 2123778 | 2/1984 | United Kingdom | 114/293 |

*Primary Examiner*—Jesús D. Sotelo
*Assistant Examiner*—Stephen P. Avila
*Attorney, Agent, or Firm*—Stephen R. Doody

[57] ABSTRACT

An apparatus and method reducing the motions of a marine structure anchored in a body of water over a hydrocarbon drilling or production site using a spread type mooring system. The structure's motions are reduced by increasing the amplitude and altering the dynamic tension variation of the mooring system, without affecting the static response of the mooring system under static loads.

21 Claims, 9 Drawing Sheets

APPARATUS AND METHOD FOR REDUCING MOTION RESPONSE OF MARINE STRUCTURES

BACKGROUND OF THE INVENTION

A structure operating in a seaway is subjected to oscillatory wave forces. In response to these waves forces, a floating structure can compliantly move in up to six principal degrees of freedom. Three of the degrees of freedom are translational, namely heave (vertical), surge and sway (horizontal) motions of the structure. The other three degrees of freedom are roll, pitch and yaw motions which correspond to rotational motions about the structure's principal axes. A column-stabilized, semisubmersible structure is generally free to compliantly move in all its six degrees of freedom. However, in some semisubmersible designs, noncompliant restraint might be imposed to one or more of the degrees of freedom such as in the case of a Tension Leg Platform (TLP) which is rigidly restrained in heave by its vertical tethers.

It is a well known practice to anchor semisubmersible floating structures over a seabed site using a spread type mooring system. The structure is usually kept on location for the purposes of conducting various types of operations including hydrocarbon drilling and production operations.

The spread type mooring system, often called "catenary" mooring system, is adapted primarily to restrain the horizontal motions of the structure and keep it over the desired seabed site, within allowable limits, by resisting the prevailing environmental forces. The design of a spread type mooring system is generally well known in the art and is comprised of a plurality of mooring means arranged in a radial pattern around the perimeter of the structure. Each individual mooring means generally comprises an anchor and a mooring line, said mooring line typically comprising a wire cable or a combination of a wire cable and anchor chain.

When environmental forces, such as wind, current and waves, act against the structure to move it away from its original location, spread mooring systems develop a net horizontal force called the "restoring" force which restrains unwanted movement of the structure and ultimately "restores" the structure to its original location. The restoration force is developed by the increasing tensions in the mooring lines located on the side of the structure experiencing the environmental forces (the "windward" side), as those lines become increasingly taut due to the movement of the structure, coupled with decreasing tension in the mooring lines located on the leeside of the structure.

It is also known that the station-keeping properties of the mooring system can be improved by the addition of weights ("clump weights") attached to the mooring lines to obtain a taut catenary mooring system. U.S. Pat. No. 3,903,705 to Beck discloses the use of clump weights attached to mooring lines, said clump weights being intended to remain at least partially resting on the seabed under normal environmental conditions.

A floating structure, in conjunction with its mooring system, effectively behaves like a spring/mass system and as such is subject to excitation of its principal degrees of freedom. Excitation of any of the structure's six degrees of freedom is imparted on the structure mostly within two principal frequency bands, a first band corresponding to the range of wave frequencies having the dominant wave energy and a second band centered about the resonant frequency of each of the degrees of motion.

Structure response within the range of frequencies containing the dominant wave energy is controlled by well-known hydrodynamic principles. A particular concern associated with the design and operation of compliant, floating structures is the possibility of resonant excitation of one or more of the structure's degrees of freedom. Potentially large resonant motions can occur whenever the seaway contains wave energy near one or more of the natural periods of motion of the structure. The resulting amplitude of motion due to resonant excitation is very dependent on the amount of damping in the system, as provided by either passive or active sources. It is very desirable to provide the structure with means to avoid and/or reduce resonant excitation.

All real spring mass systems possess a finite amount of natural damping. In the case of a floating structure, the principal source of natural damping is provided by viscous hydrodynamic effects on the vessel. More recently, it has been recognized that the viscous forces developed by the changing catenary geometry of the mooring lines can also be an important passive source of damping structure motion. Since the spread mooring system is deployed at an angle in the vertical plane, the damping forces generated by the mooring system have vector components of force acting in the vertical and horizontal directions and can therefore dampen all six degrees of freedom.

U.S. Pat. No. 4,167,147 to Bergman describes a floating structure having a variety of arrangements for actively and passively producing velocity damping, i.e., antiheave forces that are proportional to the heave velocity of the structure. All of the methods described by Bergman supplement the natural damping of the structure by the addition of mechanical systems on board the structure arranged so as to generate a damping force only in the vertical direction Pending U.S. patent application by Petty, et al, Ser. No. 07/355,431, now U.S. Pat. No. 4,936,710, describes a mechanical system adapted on the mooring system to generate (coulomb) damping forces. Since the damping forces in accordance with Petty's invention are generated in conjunction with the mooring system, all six degrees of freedom, including heave and surge motions will be reduced.

Common to all the methods described above to supplement the natural damping characteristics of the structure and reduce structure motions is the need for modifying existing mechanical means or the addition of mechanical systems such as hydraulic cylinders, thrusters and so forth, all of which require various levels of on-going maintenance to ensure that the systems will function properly when required, usually in the event of an extreme storm. Further, various levels of operator intervention may be required, depending on the system, to operate the system through the passage of the storm. The need for maintenance of mechanical systems and/or special operating procedures introduces reliability risks, especially when operators are required to make critical decisions or maneuvers in very adverse weather conditions.

SUMMARY OF THE INVENTION

It is an object of the present invention to provide a floating structure with a fully passive means to reduce motions, which means is not dependent upon any mechanical system, is maintenance free, and requires no operator intervention, decisions or maneuvers. In accordance with this invention, the structure is provided with mooring means and means, responsive to the motion of said mooring means, for increasing the amplitude and altering the phase of the dynamic tension variation of the mooring means.

DESCRIPTION OF THE PREFERRED EMBODIMENTS

The objects and advantages of the present invention are achieved through the provision of a marine structure, as for example the floating drilling and production platform 10 which is best depicted in figure two. Although the fullest benefits of the invention are achieved in a marine structure which is floating, i.e., one which rises with a rising tide and falls with a falling tide, the invention also relates to all types of marine structures including tension leg platforms, bottom-fixed towers and partially buoyant structures which touch or partially rest on the seabed.

Figure 1:
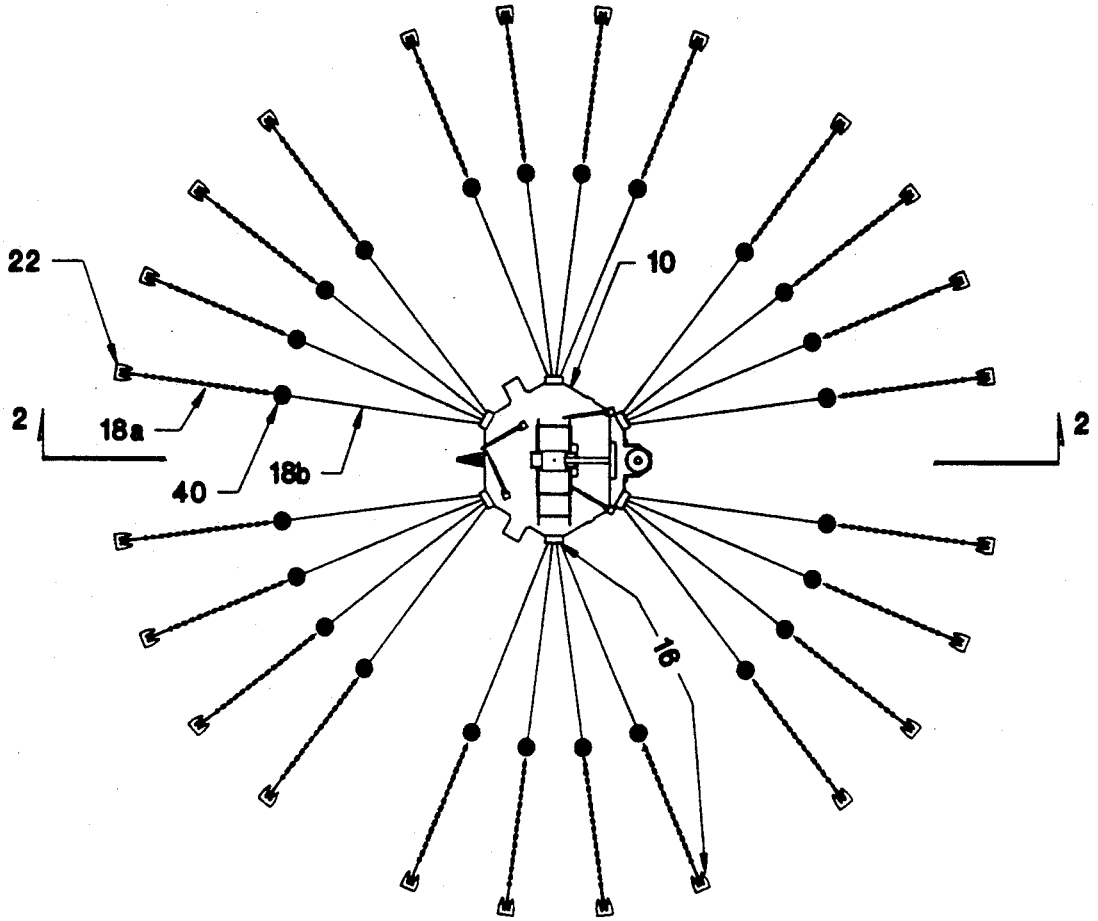
FIG. 1 is a top view of a floating structure being held in position by a spread mooring system.

As shown in figure two, the structure is situated over a desired original site 12 on the seabed 13, such that drill pipe and production risers 14 may extend in a substantially vertical line between the seabed site 12 and the structure 10. The structure is held in position over the desired seabed site by a plurality of mooring means 16, as shown in FIG. 1, arranged in a radially symmetrical pattern around the perimeter of the structure. For the sake of clarity, only two mooring means 16 have been depicted in FIG. 2.

Figure 2:
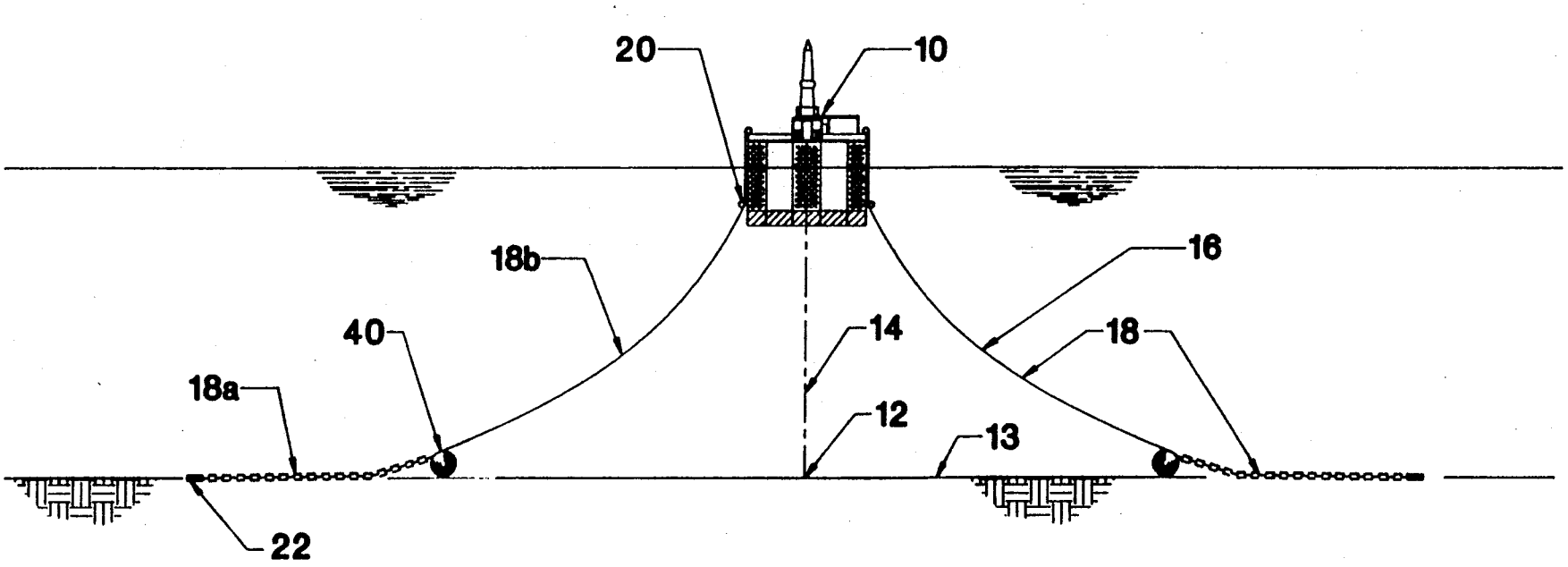
FIG. 2 is a side elevational view taken along line 2—2 of FIG. 1.

As shown in FIGS. 1 and 2, mooring means 16 comprises a mooring line 18, one end of which extends from a fairlead 20 on the structure to the seabed 13 and is attached to an anchor 22 on the seabed. Although depicted as a drag-type anchor in FIG. 2, anchor 22 may take any form, including pile anchors and gravity anchors.

Mooring line 18 comprises a wire cable **18*b* except for its lowermost segment 18*a* situated on or near the seabed, said segment 18*a*** comprising a material which is heavier and more abrasive-resistant than wire cable, such as anchor chain. In such combination chain-wire cable mooring lines, the chain and wire cable are connected using any of a number of conventional techniques.

Attached to the mooring lines 18 are clump weights 40. Said clump weights may be attached to the mooring lines in a number of manners and positions such as normally on bottom, as disclosed in U.S. Pat. No. 3,903,705 to Beck, or normal off bottom, as shown in FIGS. 1 and 2.

The combination of a high strength wire cable **18*b* and a heavy clump weight 40 operating at relatively large pretensions produces a taut configuration as shown in FIG. 2** which has much less catenary deflection than is conventionally associated with spread type mooring systems. This taut configuration considerably improves the station-keeping performance of the mooring system.

Figure 3:
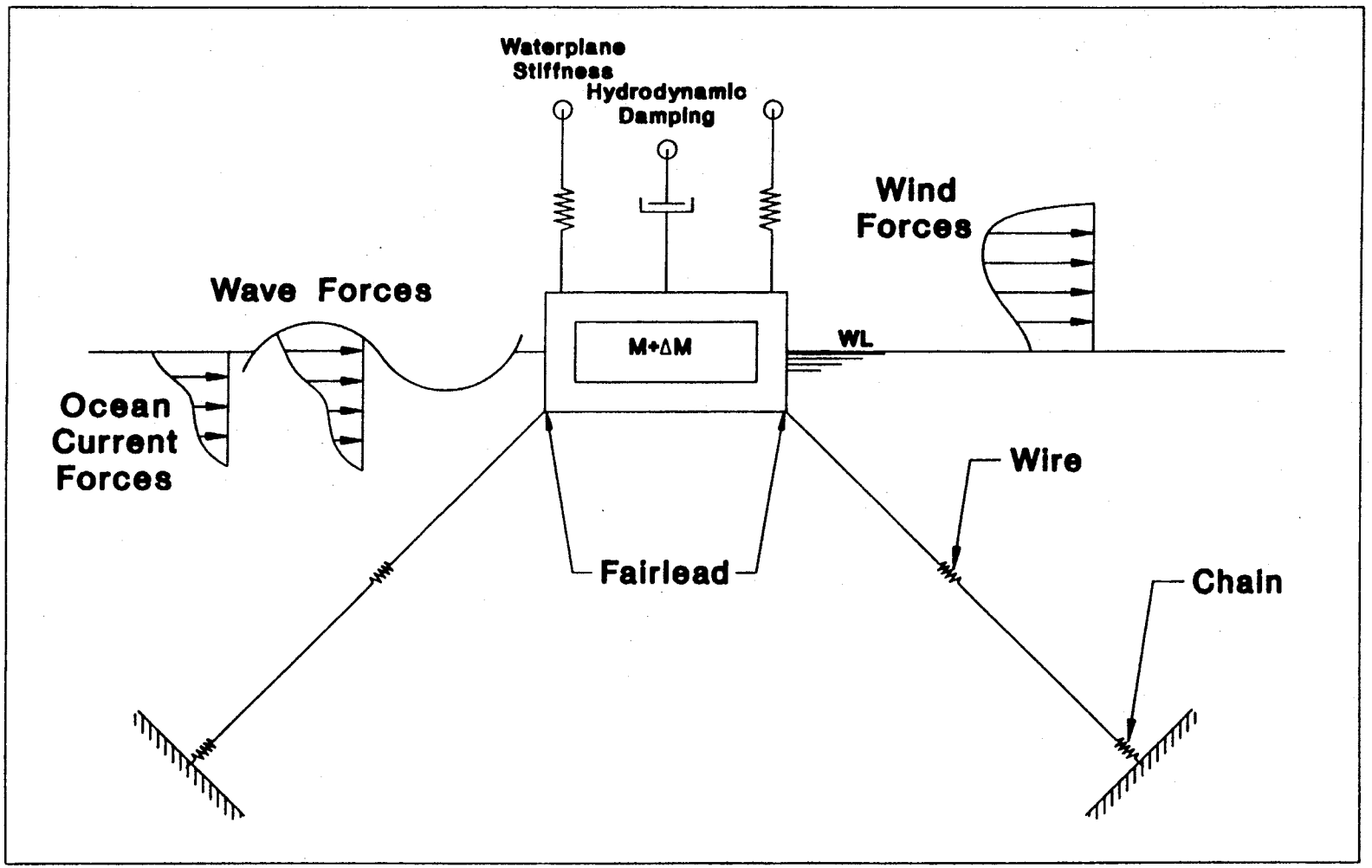
FIG. 3 depicts a physical model of a moored, floating structure in accordance with static behavior assumptions.

By conventional design methods, the configuration of the mooring system, sizing of the components such as the capacity and length of the anchor 22, the submerged weight of the clump weights 40, and the pretension and capacity of the wire cable 18, are all selected based on static load assumptions and static behavior of the mooring system and structure. Accordingly, a moored floating structure is conventionally assumed to behave following the physical model depicted in FIG. 3. Typically, static mooring line tensions and horizontal restoring forces are evaluated over an incremental range of static offset positions. The mooring system is assumed to behave like a combination of massless springs in which the tension variation in a mooring line 18 is strictly a function of the displacement of the fairlead 20 from which said mooring line extends, in accordance with the following expression (Equation No.1):

$$\delta T(\epsilon) = -A \cdot R(\epsilon) \qquad \text{Eq. 1}$$

where:

$\delta T(\epsilon)$ = Line tension variation as a function of fairlead displacement A = Amplitude of fairlead displacement $R(\epsilon)$ = Displacement dependent line tension variation transfer function $\epsilon$ = Fairlead displacement Pursuant to said assumptions, the resulting horizontal and vertical mooring force components, respectively, acting on the structure may be expressed as follows: (Equation No. 2)

$$Fh(\epsilon) = \sum_i -A_i \cdot R(i,\epsilon) \cdot \cos(\alpha) \quad \text{for } i = 1 \ldots n \qquad \text{Eq. 2}$$

where:

$Fh(\epsilon)$ = Total horizontal mooring force variation as a function of fairlead displacement A = Amplitude of fairlead displacement $R(i,\epsilon)$ = Displacement dependent line tension variation transfer function $\alpha$ = Mooring line angle at fairlead i = Mooring line number n = Total number of mooring lines (Equation No. 3)

$$Fv(\epsilon) = \sum_i -A_i \cdot R(i,\epsilon) \cdot \sin(\alpha) \quad \text{for } i = 1 \ldots n \qquad \text{Eq. 3}$$

where:

$Fv(\epsilon)$=Total vertical mooring force variation as a function of fairlead displacement A=Amplitude of fairlead displacement $R(i,\epsilon)$=Displacement dependent line tension variation transfer function $\alpha$=Mooring line angle at fairlead i=Mooring line number n=Total number of mooring lines For shallow-water moorings, where it is economically feasible to use anchor chain for the entire length of mooring line 18, and for structures with reasonable levels of natural damping, the above described static analysis methods may provide an acceptable approximation of mooring loads and structure performance. However, for lightly damped marine structures such as shown in FIG. 2, especially in deep water moorings where mooring lines 18 are a combination of anchor chain and wire cable, the static analysis methods do not provide an accurate assessment of mooring loads and structure motions.

Figure 4:
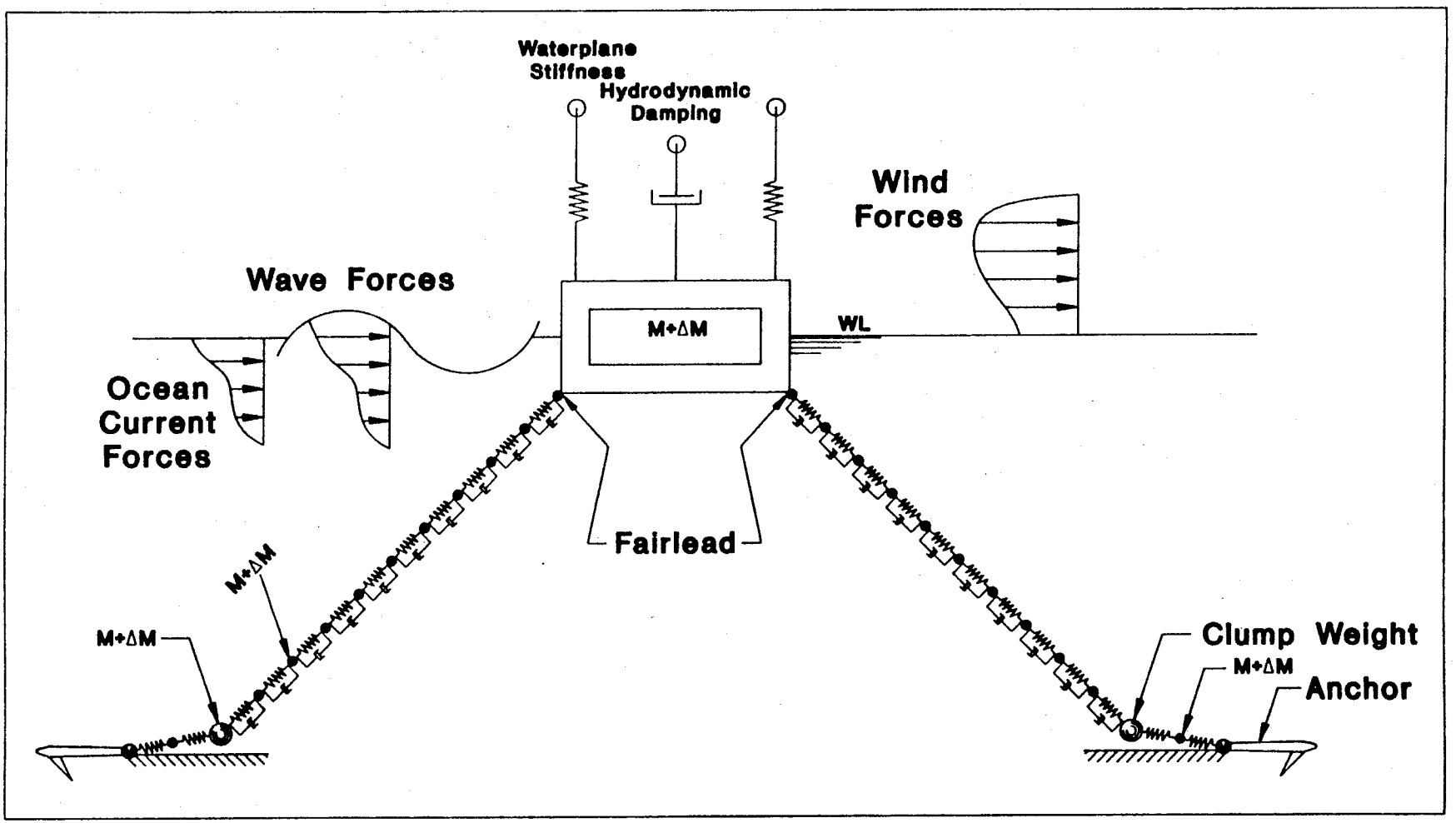
FIG. 4 depicts a physical model of a moored, floating structure in accordance with dynamic behavior assumptions.

A more rigorous and realistic physical model of a moored, floating structure is depicted in FIG. 4. As shown in FIG. 4, the mooring system is represented by a series of springs and masses, including the mass of clump weight 40. Wire cable 18*b* has a finite hydraulic diameter and thus will subjected to viscous forces as it moves through the water. In accordance with this more realistic dynamic model, the mooring line tension variation measured at the fairlead 20 will be frequency dependent as well as a function of fairlead displacement. The following expression (Equation 4) shows the frequency dependent tension variation or impedance relationship for a mooring line in accordance with said dynamic model:

$$\delta T(\omega) = -A(\omega)\cdot R(\omega)\cdot\omega\cdot\cos(\phi(\omega)) + A(\omega)\cdot R(\omega)\cdot\sin(\phi(\omega)) \quad \text{Eq. 4}$$

where:

$\delta T(\omega)$=Dynamic line tension variation as a function of frequency $A(\omega)$=Amplitude of fairlead displacement as a function of frequency $R(\omega)$=Frequency dependent line tension variation transfer function $\phi(\omega)$=Phase angle of response as a function of frequency $\omega$=Radial frequency The following expressions represent the resulting frequency dependent horizontal and vertical mooring force components, respectively, acting on the structure in accordance with said dynamic model:

(Equation No. 5)

$$\delta Fh(\omega) = \sum_i [A(i,\omega)\cdot R(i,\omega)\cdot[-\omega^2\cdot\cos(\phi(i,\omega)) + \omega\cdot\sin(\phi(i,\omega))]\cdot\cos(\alpha)] \quad \text{Eq. 5}$$

where $\delta Fh(\omega)$=Total horizontal dynamic mooring force variation as a function of frequency $A(i,\omega)$=Amplitude of fairlead displacement $R(i,\omega)$=Frequency dependent line tension variation transfer function $\phi(i,\omega)$=Frequency dependent phase angle of response $\alpha$=Mooring line angle at fairlead i=Mooring line number n=Total number of mooring lines (Equation No. 6)

$$\delta Fv(\omega) = \sum_i [A(i,\omega)\cdot R(i,\omega)\cdot[-\omega^2\cdot\cos(\phi(i,\omega)) + \omega\cdot\sin(\phi(i,\omega))]\cdot\sin(\alpha)] \quad \text{Eq. 6}$$

where:

$\delta Fv(\omega)$=Total vertical dynamic mooring force variation as a function of frequency $A(i,\omega)$=Amplitude of fairlead displacement $R(i,\omega)$=Frequency dependent line tension variation transfer function $\phi(i,\omega)$=Frequency dependent phase angle of response $\alpha$=Mooring line angle at fairlead i=Mooring line number n=Total number of mooring lines Assuming a cosine function displacement of the fairlead 20, it can be seen that the terms for horizontal and vertical components of mooring force variation contain both an in-phase and out-of-phase terms. With the existence of some phase lag between fairlead displacement and mooring response, the nature of the in-phase term of mooring force variation behaves like a stiffness force, and the out-of-phase term behaves like a damping force, both of which will directly affect structure motion.

For the mooring system to generate any significant out-of-phase force at any given frequency, the impedance functions of equations 5 and 6 show that existence of both a force variation "δF" and a phase lag "Φ" are required. Generally, for compliant structures operating in random seaways, most of the energy of the structure's motion often occurs at the resonant frequencies of the structure. Hence, an out-of-phase force component generated as a result of the dynamic response of the mooring system will be most useful if adapted to reduce the resonant responses of the structure including surge, sway and heave motions.

While looser catenary systems accommodate fairlead displacements mostly by changes in the catenary shape of the mooring lines 18, a tightly configured chain/wire mooring systems with clump weights, as shown in FIG. 2, accommodates fairlead displacements not only by changing catenary geometry of mooring lines 18 but also by a proportionally larger contribution of stretch of wire cable 18*b*. Consequently, the axial properties and the dynamic axial response of the mooring lines 18 play an important role in the resulting structure response.

One particular aspect of such axial properties, the celerity of an axial stress wave in wire cable 18*b*, is most important. The celerity of an axial wave has a finite value, and the corresponding response time or lag in long mooring cables contributes to the phase angle (Φ) in the impedance function of equation 4. The celerity of an axial wave travelling in wire cable 18*b* is expressed as follows (Equation 7):

$$Ca = \sqrt{\frac{E}{\rho}} \quad \text{Eq. 7}$$

where:

Ca=Celerity of longitudinal (axial) wave

E=Elastic modulus of mooring wire $\rho$ = Mass density of mooring wire

The invention resides in optimally increasing the amplitude and altering the phase of dynamic mooring force variation for the specific purpose of reducing structure motions about one or more of its degrees of freedom. Preferably the dynamic mooring force variation is altered as to generate a minimum in-phase (stiffness) force component and a maximum out-of-phase (damping) force component. The invention is preferably embodied in one or more of the following methods and means: reducing the modulus of wire cable 18*b*, increasing the dynamic mass of mooring means 16 and increasing the dynamic mass of clumps 40.

As shown in equation 7, decreasing the modulus (E) of the cable wire 18*b* will reduce the axial celerity in said wire cable, and therefore increase the lag in response or phase angle ($\Phi$) in the impedance function. The modulus of wire cable 18*b* can be varied by modifying the construction of said wire cable and/or by selecting a material that possesses greater stretch characteristics than steel, such as aluminum or synthetics.

Also according to the invention, means are provided for increasing the dynamic mass of mooring means 16 in response to motion of said mooring means relative to the water in which structure 10 is situated. As shown in equation 7, increasing the dynamic mass of mooring means 16 will reduce its axial celerity and therefore increase the lag in response or phase angle ($\Phi$) in the impedance function. It will also increase the amplitude of the dynamic mooring line tension variation.

Figures 5, 5A:
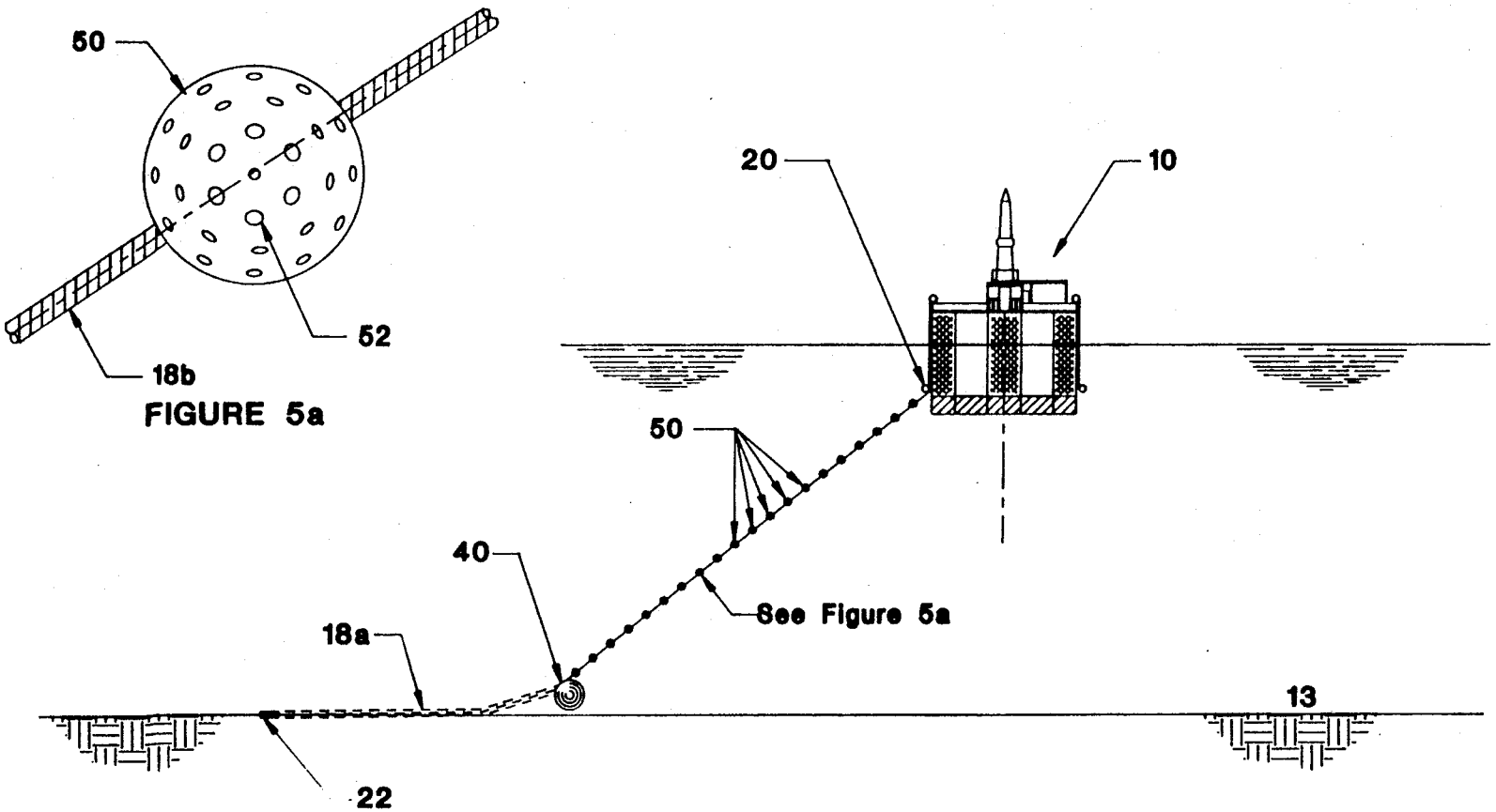
FIG. 5 is a fragmentary view of a floating structure showing means for increasing the dynamic mass of the mooring system in accordance with the invention.

Said dynamic mass increasing means are preferably comprised of one or more bodies or nodes 50, shown in FIG. 5, located on wire cable 18*b*. Alternatively, nodes 50 could be located at any point along and attached to any component of mooring means 16. In the embodiment depicted in FIG. 5, nodes 50 are spaced approximately 100 feet apart along wire cable 18*b*. It is understood, however, that said nodes could be spaced closer or further apart along wire cable 18*b*, or a plurality of nodes 50 could be grouped together at one or more points along wire cable 18*b*, or said nodes could be spaced unevenly along wire cable 18*b*.

While it could be a solid body, node 50 is preferably hollow and flooded with a fluid, preferably water. Node 50 may be made of any material, but is preferably made of a material which is sufficiently rigid to resist deformation, as for example, concrete, steel, hard plastic and stiff rubber.

The dynamic mass of node 50 is equal to the sum of the mass of fluid entrained internally in the node's hollow, if any, plus the amount of water entrained on the outside of the node. The amount of the internally entrained fluid mass is a function of the volume of the node's hollow. The amount of the externally entrained fluid mass, sometimes referred to as the "added" mass is a function of the external shape of the node.

A preferred embodiment of node 50 is depicted in FIG. 5 as a hollow, thin-shelled spherical body. Holes 52 are provided in the shell of node 50 so as to allow the submerged node to become filled with water. The "shape factor" or "coefficient of added mass" for a sphere is 0.5, which means that the mass of the externally entrained water for a sphere is a function of one-half the sphere's volume. Hence, the total dynamic mass associated with the hollow and flooded spherical node depicted in FIG. 5, i.e., including the internally and externally entrained water mass, is 1.5 times the volume of said node times the mass density of water.

Figure 6:
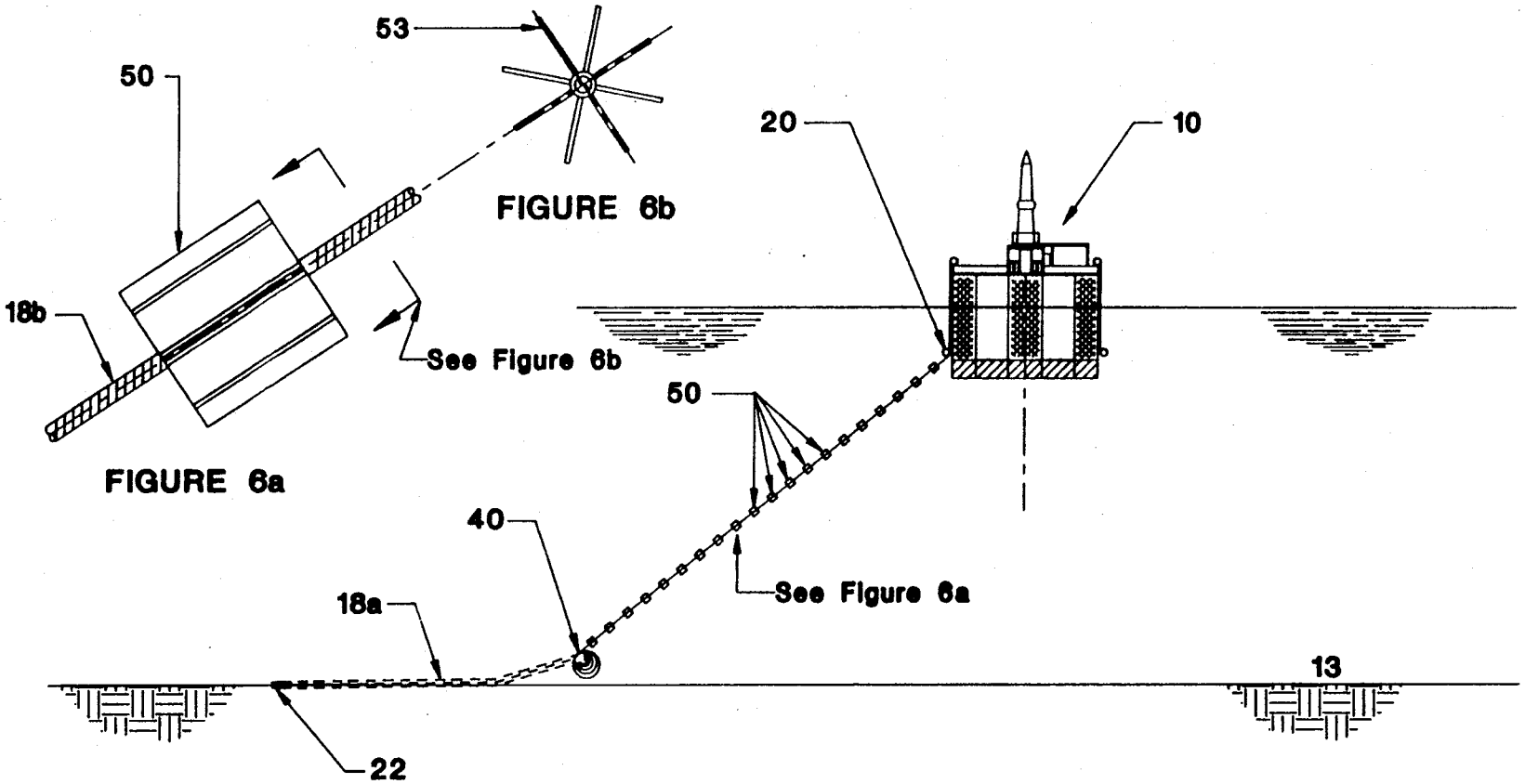
FIG. 6 is a fragmentary view of a preferred embodiment of a dynamic mass increasing means attached to a mooring line.

An alternative embodiment of node 50 is shown in FIG. 6 as having external appendages 53 protruding or extending from the outer surface of the node. Due to the propensity of such appendages to "grab" water, the shape factor associated with the node depicted in FIG. 6 is significantly higher than the shape factor of the spherical node depicted in FIG. 5. Although the external appendages 53 as shown in FIG. 6 are in the form of fins, it is understood that appendages or projections from the external surface of a node may take any shape or form.

Figures 7, 7A:
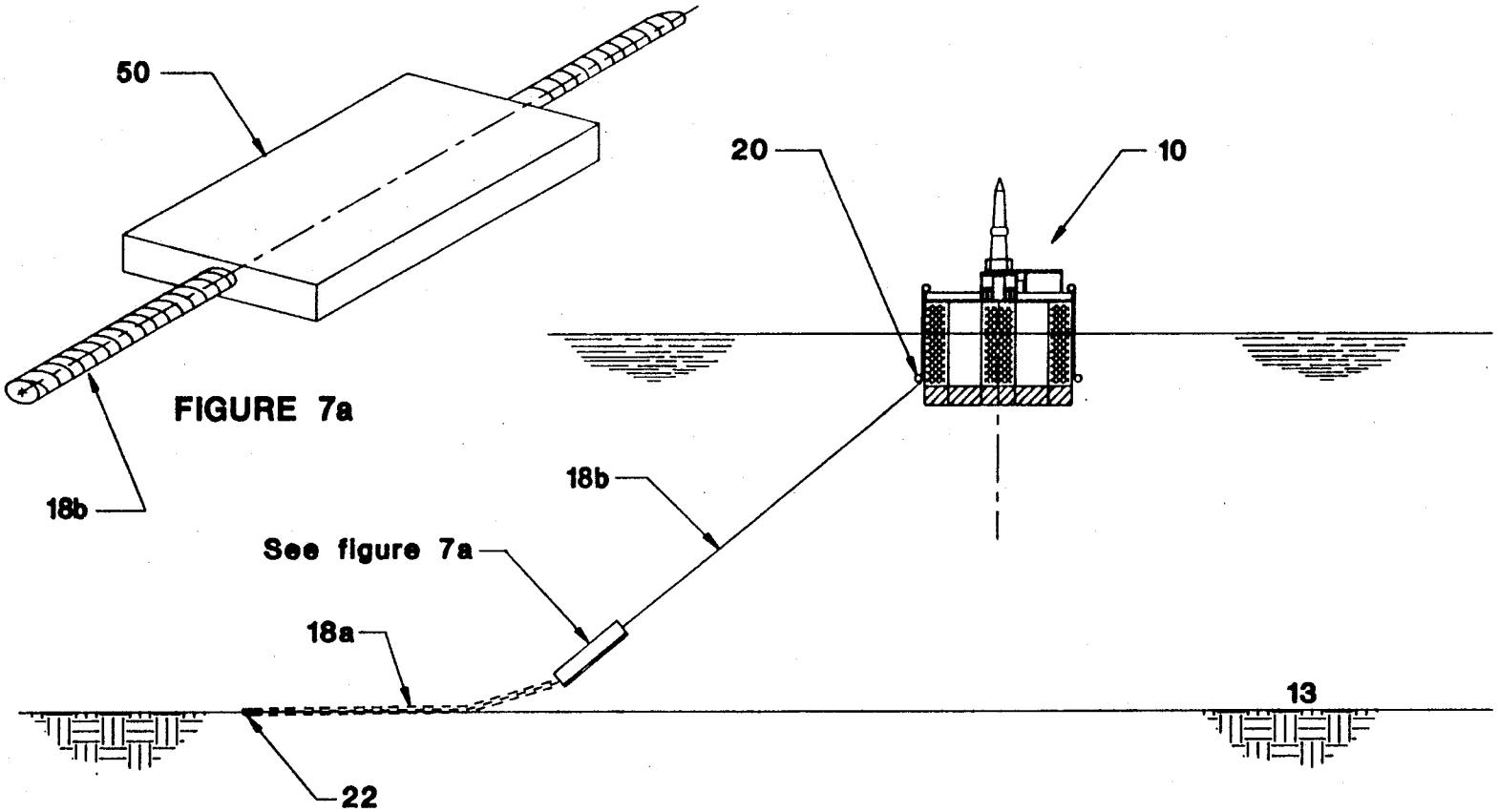
FIG. 7 is a fragmentary view of an alternate embodiment of a dynamic mass increasing means.

Yet another alternative embodiment of node 50 is shown in FIG. 7, wherein node 50 takes the shape of a thin slab. In FIG. 7, node 50 also serves the purpose of a clump weight.

Node 50 may have a zero submerged weight, or a positive submerged weight or a negative submerged weight, i.e., it may be buoyant. Preferably, node 50 has little, if any, positive submerged weight, so as not to adversely affect the static properties of the mooring system under static load conditions.

Node 50 may be permanently connected to mooring means 16, as by welding or cementing. Alternatively, node 50 may be detachably connected to mooring means 16, as by bolting or other form of locking mechanism, thereby allowing nodes to be selectively added to, removed from or repositioned along mooring means 16. Whatever the mechanism or means for attaching node 50 to mooring means 16, the connection should be such as to minimize slippage or movement so that motion of mooring means 16 is directly applied and transferred to the attached node 50.

Further in accordance with the invention, the means for increasing the amplitude and altering the phase of the dynamic mooring force variation in response to motion of mooring means 16, comprises a clump weight. Said clump weight in accordance with the invention has the desired submerged weight as determined by the station-keeping requirements under static loads pursuant to conventional mooring design practice, but also has an enhanced dynamic mass due to its structure and configuration.

Conventionally, clump weights 40 are made of some high density material such as concrete or pig iron, and cast into a desired solid shape such as is shown in FIG. 2. However, clump weight 40 in accordance with a preferred embodiment of the invention is a hollow, fluid-filled body, as for example the clump weight 40*a* depicted in FIG. 8. Clump weight 40*a* is a hollow, water-filled cylindrical shell having closed ends. By design, clump weight 40*a* has a submerged structural weight equal to the desired submerged weight of a conventional, solid clump weight.

In accordance with this invention, it is possible, by varying the shape and size of the hollow clump weight, to vary the total dynamic mass of the clump weight and thereby optimally alter the amplitude and phase of mooring line tension variations and thus alter the amplitude and phase of the total horizontal and vertical components of dynamic mooring force variations. Preferably, the amplitude and phase of dynamic mooring force variation is altered in such a fashion as to reduce resonant motions of the structure 10. Resonant motions of the structure 10 are reduced by an increase in the amplitude of the out-of phase force component of the mooring lines 18.

Analogous to the description set forth above with respect to node 50, the dynamic mass of each clump weight is equal to the sum of the internally entrained mass of water and the entrained added mass of water outside the clump weight. The internally entrained mass is a function of the volume of the hollow of the clump weight, while the externally entrained mass varies with the external shape of the clump weight.

Figure 8:
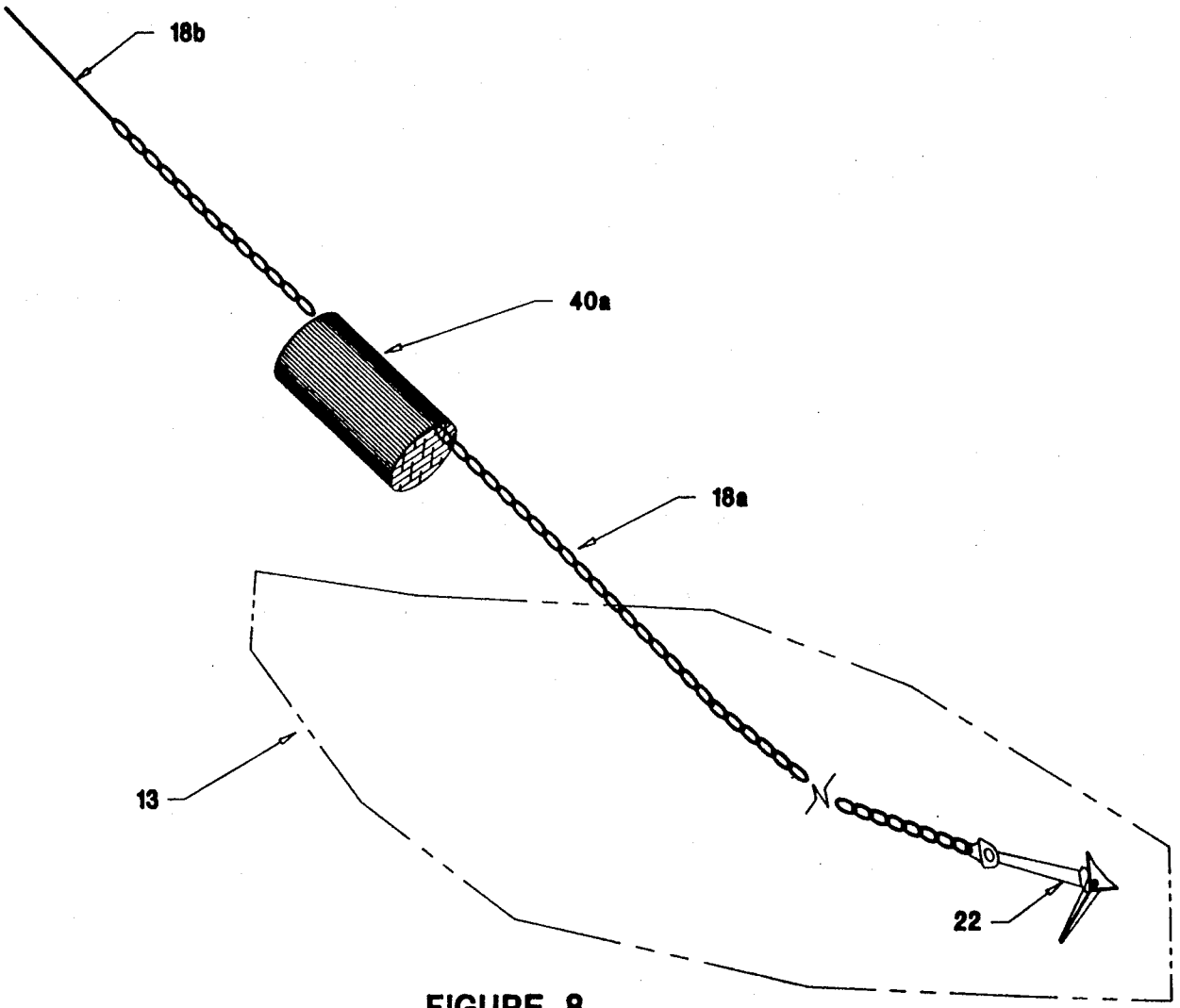
FIG. 8 is a perspective, fragmentary view of a clump weight in accordance with the invention.

For a cylindrical clump weight, such as clump weight 40a depicted in FIG. 8, the shape factor or coefficient of added mass would be 1.0. Hence, the total dynamic mass associated with clump 40a is two times the volume of the cylinder times the mass density of water. Since the submerged weight of hollow clump weight in accordance with the invention is by design the same as would be required for a solid clump weight, the station-keeping performance of the mooring system utilizing said hollow clump weight under static loads is unaffected.

It will be recognized that the benefits of this invention are achieved by taking advantage and altering the physical behavior of a very complex, multi-mass, multi-spring, dynamic system. It will also be recognized that, in accordance with the invention, the dynamic response of the mooring system can be altered in such a fashion as to reduce simultaneously the response of several principal motions or altered to optimally reduce the response of a single vessel motion. For example, certain types of floating structures are operationally more sensitive to resonant horizontal motions while others are more specifically sensitive to resonant heave motions. By proper optimization of the mooring system design in accordance with the principals of this invention, it is possible to optimally reduce one or more resonant motions while accepting a lesser or null reduction of less operationally sensitive motions.

As an example of a clump weight in accordance with this invention, assume that structure 10 is moored over a seabed site in water a depth of 3000 feet, structure 10 consisting of an upper hull, a submerged lower hull and six symmetrically arranged stability columns connecting the lower and upper hulls, said structure having an operating draft of 350 ft and a displacement of 205,000 long tons.

A preferred mooring system under such an example comprises a radially arranged, spread-type mooring system having 24 mooring means. Each such moring means comprises a 60 ton embedment anchor, 1500 ft. of 6 inch anchor chain, 4600 ft. of high strength wire cable and a clump weight interposed between the chain and wire cable. The wire cable is of spiral strand construction, has a nominal diameter of 5 inches, a stretch coefficient of $344\times10^6$ and a breaking strength of 3400 kips. The submerged weight of the clump weight required for station-keeping under static environmental loads is 300 kips. The operating pretension of the mooring lines is between 1000 and 1100 kips. As configured, all clump weights are suspended 15 to 20 feet above the seabed under normal operating conditions.

Figure 9:
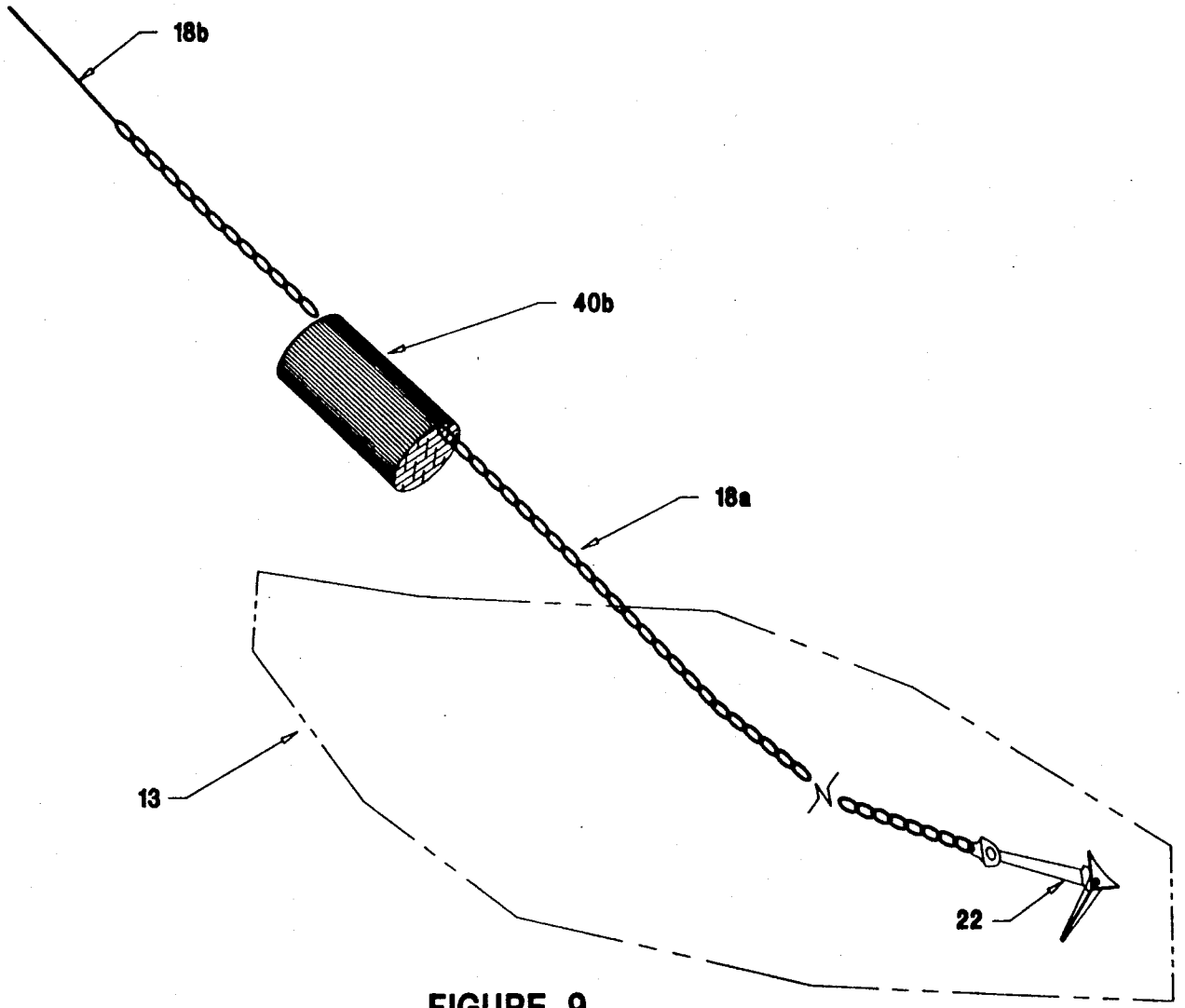
FIG. 9 is a perspective, fragmentary view of a clump weight having an external shape similar to that shown in FIG. 8.

In the foregoing example, the clump weights pursuant to conventional design would typically be comprised of high density concrete having a solid configuration. Assuming such solid clump weights to have the shape of a cylinder, as depicted in FIG. 9, each such clump weight under conventional design would have a 10 ft. diameter and would be 20 ft. in length. The submerged weight of each clump weight would be 300 kips, and each such clump weight would have a dynamic mass of 3,140 slugs.

In accordance with a preferred embodiment of the invention, the solid clump weight depicted in FIG. 9 is replaced by a similarly-shaped but hollow, water-filled, cylindrical shell, as depicted in FIG. 8, having an outside diameter of 20 feet and a length of 30 feet. Said hollow clump weight in accordance with the invention has the same submerged weight as the solid cylinder, i.e., 300 kips, but it has a considerably larger dynamic mass of 34,422 slugs.

The above described example does not necessarily represent the optimal configuration for the preferred embodiment of this invention but is only used to illustrate the principals of the invention.

While specific embodiment of the invention have been shown and described in detail to illustrate the application of the principles of the invention, it will be understood that the invention may be embodied otherwise without departing from such principles.

What is claimed is:

1. An apparatus for reducing motion of a marine structure situated in a body of water above a seabed, comprising:

means for mooring the marine structure to the seabed; and means for increasing the dynamic mass of the mooring means in response to motion of the mooring means, said dynamic mass increasing means being attached to the mooring means and having a negligible submerged weight which remains constant.

2. The apparatus of claim 1 wherein said dynamic mass increasing means is attached to the mooring means at a distance above the seabed such that said dynamic mass increasing means does not touch the seabed under normal operating conditions of the structure.

3. The apparatus of claim 2 wherein said dynamic mass increasing means comprises a hollow, thin-shelled spherical body having a surface opening such that the interior of the body is open to the sea.

4. The apparatus of claim 2 wherein said dynamic mass increasing means comprises a hollow, close-ended cylindrical shell containing a fluid.

5. The apparatus of claim 2 wherein said dynamic mass increasing means includes appendages extending outwardly from the surface of said means in order to increase the amount of externally entrained water as said means moves through the water in response to motion of the mooring means.

6. A method for reducing motion of a marine structure situated in a body of water above a seabed and equipped with mooring means, comprising the steps of:

attaching the mooring means to the seabed; and providing means, having a constant submerged weight, for increasing the amplitude and altering the phase of the dynamic tension variation of the mooring means in response to motion of said mooring means.

7. The method of claim 6 in which the step of providing the increasing and altering means is performed by attaching said means to the mooring means at a distance above the seabed such that said increasing and altering means does not touch the seabed under normal operating conditions of the structure.

8. The method of claim 6 wherein the step of providing the increasing and altering means is performed without altering the station-keeping performance of the mooring means under static loading.

9. The method for reducing the motion of a marine structure situated in a body of water above a seabed and attached to the seabed by mooring means having a clump weight, comprising the steps of:

removing the clump weight from the mooring means; and replacing said clump weight with a body having the same submerged weight as the clump weight but having a considerably larger dynamic mass than the clump weight so as to increase the amplitude and alter the phase of the dynamic tension variation of the mooring means in response to motion of said mooring means.

10. An apparatus for reducing the motion of a marine structure situated in a body of water above a seabed, comprising:

mooring means attached from the structure to the seabed for keeping the structure in position over a desired seabed site; and means, attached to the mooring means, for increasing the amplitude and altering the phase of the dynamic tension variation of the mooring means in response to motion of the mooring means without altering the position-keeping performance of the mooring means under static loading.

11. The apparatus of claim 10 wherein said means for increasing the amplitude and altering the phase of the dynamic tension variation has a submerged weight which remains constant.

12. An apparatus for reducing motion of a marine structure situated in a body of water above a seabed, comprising:

means for mooring the marine structure; and a body attached to said mooring means, said body having a constant submerged weight such that it satisfies static restoring force requirements of the structure and having a dynamic mass such that it reduces resonant motion of the structure.

13. An apparatus for reducing motion of a marine structure situated in a body of water above a seabed, comprising:

means for mooring the marine structure; and means, responsive to the motion of said mooring means, for increasing the amplitude and altering the phase of the dynamic tension variation of the mooring means, said increasing and altering means creating a phase lag between structure motion and mooring responses such that said phase lag is greater than 10 degrees and less than 170 degrees.

14. An apparatus for reducing motion of a marine structure situated in a body of water above a seabed, comprising:

means for mooring the marine structure to the seabed; and means for increasing the dynamic mass of said mooring means in response to motion of said mooring means, wherein said dynamic mass increasing means is attached to said mooring means and has a submerged weight which remains constant.

15. The apparatus of claim 14 wherein said means for increasing the dynamic mass of the mooring means comprises a solid body.

16. The apparatus of claim 14 wherein said means for increasing the dynamic mass of the mooring means comprises a hollow, fluid-entraining body having a surface opening such that the interior of said body is open to the sea.

17. The apparatus of claim 14 wherein said means for increasing the dynamic mass of the mooring means includes outwardly extending appendages which do not come into contact with the seabed under normal operating conditions of the structure.

18. The apparatus of claim 14 wherein said means for increasing the dynamic mass of the mooring means has a negligible submerged weight.

19. The apparatus of claim 14 wherein said means for increasing the dynamic mass of the mooring means is buoyant.

20. The apparatus of claim 14 wherein said means for increasing the dynamic mass of the mooring means comprises a body having an internally entrained fluid mass which is at least as great as the mass of said body.

21. The apparatus of claim 14 wherein said means for increasing the dynamic mass of the mooring means comprises a body shaped such that the mass of water entrained externally by the body is at least as great as the mass of the body.

* * * * *